United States Patent [19]

Levine

[11] 4,125,904

[45] Nov. 21, 1978

[54] SHOULDER STRAP PAD

[76] Inventor: Shirley Levine, 71 Gerry Rd., Chestnut Hill, Mass. 02167

[21] Appl. No.: 794,307

[22] Filed: May 5, 1977

[51] Int. Cl.[2] ..... A41D 27/26

[52] U.S. Cl. ..... 2/267

[58] Field of Search ..... 2/267, 2; 24/86 R, 43 LG; 224/5

[56] References Cited

U.S. PATENT DOCUMENTS

| | | | |
|---|---|---|---|
| 978,821 | 12/1910 | Brown et al. | 224/5 |
| 980,421 | 1/1911 | Jordon | 2/2 X |
| 2,476,712 | 7/1949 | Eisenberg | 2/2 X |
| 3,710,391 | 1/1973 | McGlynn | 2/2 |

*Primary Examiner*—Werner H. Schroeder
*Assistant Examiner*—Doris L. Troutman
*Attorney, Agent, or Firm*—Richard J. Birch

[57] ABSTRACT

The strap of a shoulder bag is carried in comfort by a pad having a soft base provided with a non-slip lower surface, a cover snap-fastened to the base adjacent the strap edges, and a veneer removably attached to the upper surface of the cover, which selectively matches the bag.

5 Claims, 2 Drawing Figures

SHOULDER STRAP PAD

SHOULDER STRAP PAD

This invention relates to shoulder strap pads, and more particularly to pads for shoulder bag straps.

BACKGROUND OF THE INVENTION

Pads for shoulder bag straps are known but there still exists a need for pads which prevent the bag strap from slipping on the shoulder of the wearer, which is comfortable, as well as fashionable, and which can be quickly and easily adapted to match the bag being worn at the time.

SUMMARY OF THE INVENTION

The strap of a shoulder bag is supported on the shoulder of the wearer by the novel device of the invention comprising a non-slip base of flexible, soft material on which the strap rests, being covered by a leather cover which is connected to the base by snap fasteners adjacent the strap edges. A veneer which matches that of the bag is removably attached to the upper surface of the cover for convenient change as desired.

DETAILED DESCRIPTION OF THE INVENTION

Figure 1:
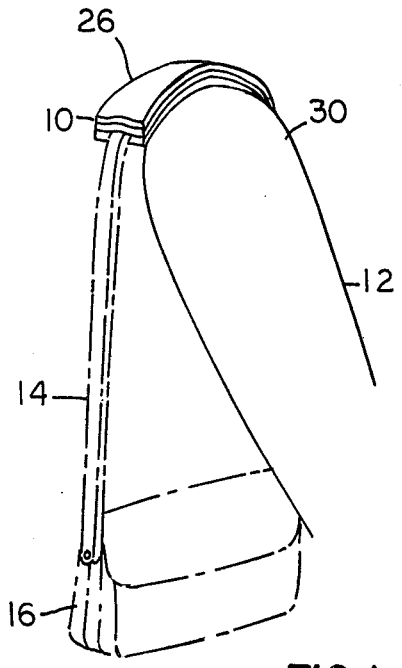
FIG. 1 is a fragmentary perspective view of a shoulder strap pad embodying the invention in use.
Figure 2:
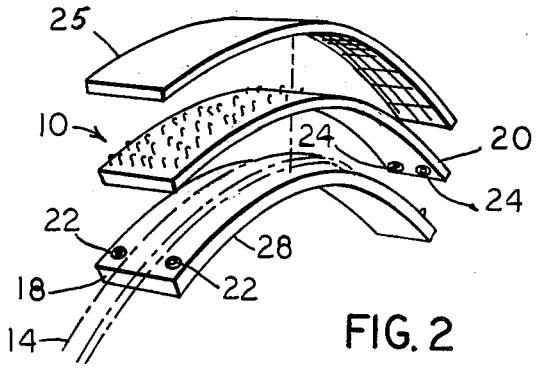
FIG. 2 is an enlarged exploded view showing the parts of the pad in perspective.

As shown in FIG. 1, the shoulder strap pad 10 is worn by a person 12 to support the strap 14 of a bag 16 containing the wearer's pocketbook for example. Referring particularly to FIG. 2, the pad 10 comprises a flexible base 18, a flexible cover 20 connected to the base 18 by corresponding snap fasteners 22 and 24, and a removable veneer 25 attached to the cover 20.

The base 18 is composed of rubber, or plastic cushion, to support strap 14 comfortably on the wearer's shoulder 26, FIG. 1. The lower surface 28 of the base 18, FIG. 2, is corrugated or otherwise made to avoid slippage of the pad 10 on the wearer's apparel 30 on shoulder 26.

The cover 20 is made of leather, or other suitable material, and covers strap 14; the snaps 22, 24 being located adjacent the edges of the strap, near the runners of the pad 18 and cover 20.

The veneer 25 is made of similar or like material as that of the bag 16, and for such purpose is provided in different colors and effect for selection as desired.

The device 10 of the invention is easy to assemble; comfortable to wear; and quite fashionable in use; as well as secure on the shoulder of the person carrying the bag by virtue of the friction-gripping surface on the bottom of the pad.

I claim:

1. A shoulder pad for strap borne bags, comprising a flexible base having quick fastening means located on said flexible base adjacent to the upper corners thereof, a flexible cover having corresponding quick fastening means adapted to mate with said flexible base quick fastening means for removably fastening the flexible cover to said flexible base with the bag strap therebetween, and a veneer removable attached to said flexible cover.

2. A shoulder pad as defined by claim 1, in which said removably attached veneer matches the bag.

3. A shoulder pad as defined by claim 1, in which said flexible base comprises a rubber cushion having a corrugated lower surface for friction-gripping apparel on the shoulder of the wearer.

4. A shoulder pad as defined by claim 1, in which said quick fastening means are snap fasteners.

5. A shoulder pad as defined by claim 1, in which said flexible base is composed of rubber having a non-slip under surface, and said flexible cover is composed of leather.

* * * * *